US010713947B2

(12) United States Patent
O'Callaghan

(10) Patent No.: US 10,713,947 B2
(45) **Date of Patent: *Jul. 14, 2020**

(54) PARKING SENSORS CAPABLE OF DETERMINING DIRECTION AND SPEED OF VEHICLE ENTERING OR LEAVING PARKING LOT USING MAGNETIC SIGNATURE RECOGNITION

(71) Applicant: Parking Genius, Inc., Dallas, TX (US)

(72) Inventor: Sean O'Callaghan, Dallas, TX (US)

(73) Assignee: The Parking Genius, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/442,031

(22) Filed: Jun. 14, 2019

(65) Prior Publication Data

US 2019/0295416 A1 Sep. 26, 2019

Related U.S. Application Data

(63) Continuation of application No. 15/711,796, filed on Sep. 21, 2017, now Pat. No. 10,325,497.

(51) Int. Cl.
*G08G 1/042* (2006.01)
*G08G 1/017* (2006.01)
(Continued)

(52) U.S. Cl.
CPC ..... *G08G 1/148* (2013.01); *G06Q 50/30* (2013.01); *G08G 1/04* (2013.01); *G08G 1/042* (2013.01);
(Continued)

(58) Field of Classification Search
None
See application file for complete search history.

(56) References Cited

U.S. PATENT DOCUMENTS 3,105,221 A 9/1963 Schwarz
3,541,308 A 11/1970 Ruby
(Continued)

FOREIGN PATENT DOCUMENTS

DE 10 2005 040 983 A1 8/2006
DE 10 2014 221 751 A1 4/2016
(Continued)

OTHER PUBLICATIONS

Ferreira et al., Self-automated parking lots for autonomous vehicles based on vehicular ad hoc networking. IEEE Intelligent Vehicles Symposium, 472-479, 2014. [retrieved on Jun. 11, 2017.] Retrieved from the Internet, 9 pages<URL:https://pdfs.semanticsscholar.org/f23e/25d41e9dfee3ce8a0e2be372c64aa1e2c91f.pdf>.
(Continued)

*Primary Examiner* — John F Mortell
(74) *Attorney, Agent, or Firm* — Foley & Lardner LLP

(57) ABSTRACT

A parking inventory management system includes a sensor apparatus with at least one magnetometer configured to generate a magnetic signature of a vehicle as it drives across the sensor apparatus. A computing device performs an analysis of the magnetic signature of the vehicle as received from the at least one magnetometer, the analysis including at least comparing the magnetic signature of the vehicle as received from the at least one magnetometer to known magnetic signatures of known vehicles. The computing device performs the analysis of the magnetic signature of the vehicle by comparing the magnetic signature of the vehicle to each of the known magnetic signatures of known vehicles to thereby determine a direction of travel of the vehicle based upon the comparison.

17 Claims, 17 Drawing Sheets

(51) Int. Cl.

| | |
|---|---|
| ***G08G 1/127*** | (2006.01) |
| ***G08G 1/01*** | (2006.01) |
| ***G08G 1/14*** | (2006.01) |
| ***G08G 1/04*** | (2006.01) |
| ***G06Q 50/30*** | (2012.01) |

(52) U.S. Cl.
CPC ..... *G08G 1/127* (2013.01); *G08G 1/143* (2013.01); *G08G 1/144* (2013.01)

(56) References Cited

U.S. PATENT DOCUMENTS

| | | | | |
|---|---|---|---|---|
| 4,239,415 | A | 12/1980 | Blikken | |
| 5,331,276 | A | 7/1994 | Polvani et al. | |
| 5,491,475 | A * | 2/1996 | Rouse | G08G 1/042 324/244 |
| 5,621,314 | A | 4/1997 | Beck et al. | |
| 5,648,904 | A | 7/1997 | Scott | |
| 5,880,682 | A | 3/1999 | Soulliard et al. | |
| 6,195,020 | B1 | 2/2001 | Brodeur et al. | |
| 6,675,123 | B1 | 1/2004 | Edelstein | |
| 6,865,455 | B1 | 3/2005 | Wiegert | |
| 8,056,667 | B2 | 11/2011 | Moshchuk et al. | |
| 8,099,214 | B2 | 1/2012 | Moshchuk et al. | |
| 8,977,652 | B2 | 3/2015 | Hoefner et al. | |
| 9,311,816 | B2 * | 4/2016 | Engler | G08G 1/017 |
| 9,408,041 | B1 | 8/2016 | Abehassera et al. | |
| 9,696,721 | B1 | 7/2017 | Myers et al. | |
| 10,135,440 | B2 * | 11/2018 | Taylor | H03K 17/953 |
| 2001/0027360 | A1 | 10/2001 | Nakano et al. | |
| 2002/0190856 | A1 * | 12/2002 | Howard | G08G 1/042 340/531 |
| 2004/0012481 | A1 | 1/2004 | Brusseaux | |
| 2004/0222903 | A1 | 11/2004 | Li | |
| 2005/0046598 | A1 | 3/2005 | Allen et al. | |
| 2005/0280555 | A1 | 12/2005 | Warner | |
| 2007/0015485 | A1 | 1/2007 | Debiasio et al. | |
| 2007/0050240 | A1 * | 3/2007 | Belani | G06Q 30/0284 705/13 |
| 2007/0129974 | A1 | 6/2007 | Chen et al. | |
| 2007/0162218 | A1 | 7/2007 | Cattin et al. | |
| 2007/0245158 | A1 | 10/2007 | Giobbi et al. | |
| 2010/0026521 | A1 | 2/2010 | Noel, II | |
| 2011/0057815 | A1 | 3/2011 | King et al. | |
| 2011/0099126 | A1 | 4/2011 | Belani et al. | |
| 2011/0137773 | A1 | 6/2011 | Davis et al. | |
| 2011/0172909 | A1 | 7/2011 | Kahn et al. | |
| 2011/0213672 | A1 | 9/2011 | Redmann et al. | |
| 2012/0056758 | A1 | 3/2012 | Kuhlman et al. | |
| 2012/0092190 | A1 | 4/2012 | Stefik et al. | |
| 2012/0095791 | A1 | 4/2012 | Stefik et al. | |
| 2012/0109760 | A1 | 5/2012 | Koiso | |
| 2012/0182160 | A1 | 7/2012 | Hod | |
| 2012/0246079 | A1 | 9/2012 | Wilson et al. | |
| 2012/0285790 | A1 | 11/2012 | Jones et al. | |
| 2013/0103200 | A1 | 4/2013 | Tucker et al. | |
| 2013/0135118 | A1 | 5/2013 | Ricci | |
| 2013/0147954 | A1 | 6/2013 | Song et al. | |
| 2014/0036076 | A1 | 2/2014 | Nerayoff et al. | |
| 2014/0046506 | A1 | 2/2014 | Reichel et al. | |
| 2014/0218218 | A1 | 8/2014 | Lloreda et al. | |
| 2014/0232518 | A1 | 8/2014 | Stoehr | |
| 2014/0232563 | A1 | 8/2014 | Engler et al. | |
| 2014/0249742 | A1 | 9/2014 | Krivacic et al. | |
| 2014/0350853 | A1 | 11/2014 | Proux | |
| 2014/0368327 | A1 | 12/2014 | Darrer et al. | |
| 2015/0016661 | A1 | 1/2015 | Lord | |
| 2015/0066607 | A1 | 3/2015 | Fiorucci et al. | |
| 2015/0117704 | A1 | 4/2015 | Bulan et al. | |
| 2015/0138001 | A1 | 5/2015 | Davies et al. | |
| 2015/0149265 | A1 | 5/2015 | Huntzicker et al. | |
| 2015/0179070 | A1 | 6/2015 | Sandbrook | |
| 2015/0241241 | A1 | 8/2015 | Cudak et al. | |
| 2015/0279210 | A1 | 10/2015 | Zafiroglu et al. | |
| 2015/0294210 | A1 | 10/2015 | Martinez De Velasco Cortina et al. | |
| 2015/0317840 | A1 | 11/2015 | Dutta et al. | |
| 2015/0334678 | A1 | 11/2015 | MacGougan et al. | |
| 2015/0346727 | A1 | 12/2015 | Ramanujam | |
| 2015/0367234 | A1 | 12/2015 | Jones et al. | |
| 2015/0369618 | A1 | 12/2015 | Barnard et al. | |
| 2016/0071415 | A1 | 3/2016 | Maeda et al. | |
| 2016/0104328 | A1 | 4/2016 | Chen et al. | |
| 2016/0125736 | A1 | 5/2016 | Shaik | |
| 2016/0189435 | A1 | 6/2016 | Beaurepaire | |
| 2016/0203649 | A1 | 7/2016 | Berkobin et al. | |
| 2016/0219012 | A1 | 7/2016 | Liao et al. | |
| 2016/0275794 | A1 | 9/2016 | Chang | |
| 2016/0286627 | A1 | 9/2016 | Chen et al. | |
| 2016/0328961 | A1 | 11/2016 | Garces Cadenas et al. | |
| 2017/0008515 | A1 | 1/2017 | Seo et al. | |
| 2017/0109942 | A1 | 4/2017 | Zivkovic et al. | |
| 2017/0132922 | A1 | 5/2017 | Gupta et al. | |
| 2017/0140645 | A1 * | 5/2017 | Balid | G08G 1/0116 |
| 2017/0200365 | A1 | 7/2017 | Baker, Sr. | |
| 2018/0061145 | A1 | 3/2018 | Blustein | |
| 2018/0089631 | A1 | 3/2018 | Baker, Sr. | |
| 2018/0114438 | A1 | 4/2018 | Rajagopalan et al. | |
| 2018/0247534 | A1 | 8/2018 | Williams | |
| 2019/0088119 | A1 | 3/2019 | O'Callaghan | |
| 2019/0088129 | A1 | 3/2019 | O'Callaghan | |

FOREIGN PATENT DOCUMENTS

| | | |
|---|---|---|
| DE | 10 2014 221 777 A1 | 4/2016 |
| DE | 10 2015 202 471 A1 | 8/2016 |
| WO | WO-2015/144396 | 10/2015 |
| WO | WO-2016/130719 A2 | 8/2016 |

OTHER PUBLICATIONS

Final Office Action on U.S. Appl. No. 14/995,148 dated Mar. 12, 2019.

Final Office Action on U.S. Appl. No. 14/995,157 dated Oct. 30, 2018.

Final Office Action on U.S. Appl. No. 15/280,790 dated Apr. 2, 2019.

Final Office Action on U.S. Appl. No. 15/711,796 dated Oct. 22, 2018.

International Preliminary Report on Patentability for PCT/US2017/053672 dated Apr. 11, 2019, 13 pages.

International Preliminary Report on Pantentability re PCT/US2017/012292 dated Jul. 26, 2018, 15 pages.

International Search Report and Written Opinion for corresponding International Patent Application No. PCT/US2017/053672 dated Dec. 1, 2017, 15 pages.

International Search Report and Written Opinion for corresponding International Patent Application No. PCT/US2017012292 dated Jul. 7, 2017, 22 pages.

International Search Report and Written Opinion for PCT/US2018/52005 dated Jan. 29, 2019, 7 pages.

International Search Report and Written Opinion dated Oct. 29, 2018 in PCT/US2018/051568; 14 pages.

International Search Report and Written Opinion dated Feb. 13, 2018 for International Patent Application No. PCT/US2017/062180, 8 pages.

Non-Final Office Action on U.S. Appl. No. 15/360,670, dated Sep. 20, 2018, 11 pgs.

Non-Final Office Action on U.S. Appl. No. 14/995,148 dated Aug. 23, 2018.

Non-Final Office Action on U.S. Appl. No. 14/995,157 dated Mar. 7, 2019.

Non-Final Office Action on U.S. Appl. No. 15/280,790 dated Oct. 29, 2018.

Non-Final Office Action on U.S. Appl. No. 15/711,796 dated May 17, 2018.

Non-Final Office Action on U.S. Appl. No. 15/711,897 dated Jan. 18, 2019.

(56) References Cited

OTHER PUBLICATIONS

Non-Final Office Action on U.S. Appl. No. 14/995,157, dated May 9, 2018, 26 pgs.
Notice of Allowance on U.S. Appl. No. 15/360,670 dated Jan. 8, 2019.
Notice of Allowance on U.S. Appl. No. 15/711,796 dated Feb. 4, 2019.
Notice of Allowance on U.S. Appl. No. 15/711,796 dated Dec. 28, 2018.
Notice of Allowance on U.S. Appl. No. 15/711,796 dated Apr. 12, 2019.
Notice of Allowance on U.S. Appl. No. 15/711,796 dated Apr. 22, 2019.
International Preliminary Report on Patentability for PCT/US2017/062180 dated Jun. 6, 2019, 7 pages.
Non-Final Office Action on U.S. Appl. No. 14/995,148 dated Oct. 4, 2019.
Notice of Allowance on U.S. Appl. No. 15/711,897 dated Aug. 14, 2019.
Final Office Action on U.S. Appl. No. 14/995,157 dated Nov. 25, 2019.
Non-Final Office Action on U.S. Appl. No. 16/416,662 dated Nov. 7, 2019.
European Search Report for EP Patent Application No. 17857317.6 dated Feb. 4, 2020.
Final Office Action on U.S. Appl. No. 14/995,148 dated Feb. 14, 2020.
Final Office Action on U.S. Appl. No. 16/416,662 dated Mar. 13, 2020.
Non-Final Office Action on U.S. Appl. No. 15/280,790 dated Mar. 24, 2020.
Non-Final Office Action on U.S. 16/601,277 dated Jun. 1, 2020.

* cited by examiner

PARKING SENSORS CAPABLE OF DETERMINING DIRECTION AND SPEED OF VEHICLE ENTERING OR LEAVING PARKING LOT USING MAGNETIC SIGNATURE RECOGNITION

CROSS REFERENCE TO RELATED APPLICATION

This application is a continuation of U.S. patent application Ser. No. 15/711,796, filed Sep. 21, 2017, issuing as U.S. Pat. No. 10,325,497 on Jun. 18, 2019, and which is incorporated herein by reference in its entirety.

TECHNICAL FIELD

This disclosure is related to the field of parking lot monitoring, and, more particularly, to systems and methods for monitoring vehicle arrival, and for determining the direction and speed of arriving vehicles.

BACKGROUND

In many cities, motor vehicles such as cars are the predominant mode of transportation utilized by residents. In some cases, parking lots for motor vehicles are not monitored or attended, and motor vehicles come and go at the direction of their drivers. However, in other cases, parking lots are to be monitored using automated parking lot management systems.

For example, a device may be installed at the entrance of a parking lot that monitors the number of vehicles in the lot via a counter. However, such vehicle sensors have a variety of inherent drawbacks in their designs. For example, such vehicle sensors may be incapable of determining in what direction a vehicle is traveling, which can lead to an inaccurate count of vehicles in the parking lot in the case where a driver fails to utilize certain designated entrances and exits, or where a driver drives erratically back and forth through an entrance or exit (possibly to use a payment device placed at said entrance or exit).

Therefore, a vehicle sensor capable of detecting not only presence of a vehicle, but also the direction of the vehicle is desirable, as that would permit design of a parking monitoring system that addresses the above drawbacks. In addition, a vehicle sensor capable of also detecting speed of the vehicle would be desirable, as it would permit better monitoring of traffic flow within the parking lot. Therefore, it is evident that there has been a need for further developments in the area of parking systems and parking sensors.

SUMMARY

The above described need has now been met by the systems, technologies, techniques, and methods described hereinbelow. It should first be noted that this summary is provided to introduce a selection of concepts that are further described below in the detailed description. This summary is not intended to identify key or essential features of the claimed subject matter, nor is it intended to be used as an aid in limiting the scope of the claimed subject matter.

A parking inventory management system includes a sensor apparatus with at least one magnetometer configured to generate a magnetic signature of a vehicle as it drives across the sensor apparatus. A computing device performs an analysis of the magnetic signature of the vehicle as received from the at least one magnetometer, the analysis including at least comparing the magnetic signature of the vehicle as received from the at least one magnetometer to known magnetic signatures of known vehicles. The computing device performs the analysis of the magnetic signature of the vehicle by comparing the magnetic signature of the vehicle to each of the known magnetic signatures of known vehicles to thereby determine a direction of travel of the vehicle based upon the comparison.

A method aspect is directed to a method of determining direction of a vehicle entering a parking lot. The method includes disposing at least one sensor apparatus at each entry or exit lane to the parking lot and acquiring a respective magnetic signature of the vehicle as it drives across at least one of the sensor apparatuses. The method further includes performing an analysis of the magnetic signature of the vehicle as received from the at least one magnetometer to determine at least one of a make of the vehicle, a model of the vehicle, a speed of the vehicle, a direction of travel of the vehicle, and a position of the vehicle with respect to the at least one sensor apparatus.

BRIEF DESCRIPTION OF THE DRAWINGS

So that the above recited features can be understood in detail, a more particular description may be had by reference to embodiments, some of which are illustrated in the appended drawings, wherein like reference numerals denote like elements. It is to be noted, however, that the appended drawings illustrate various embodiments and are therefore not to be considered limiting of its scope, and may admit to other equally effective embodiments.

1B, processing circuitry local to a sensor apparatus performs the determination of the direction and speed of vehicles.

Figure 7A:
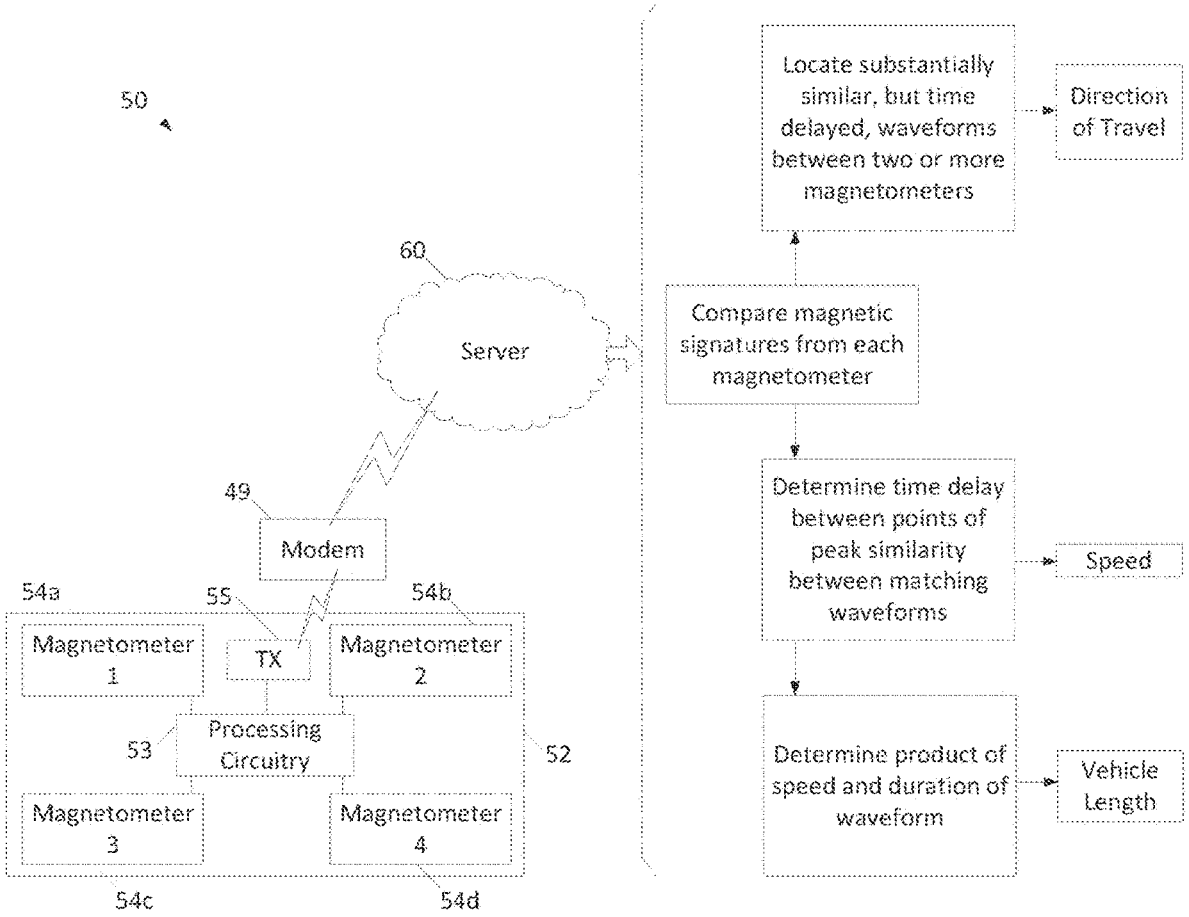
FIG. 7A is a block diagram of a parking system including vehicle sensors, the parking system being capable of determining the direction and speed of vehicles entering or exiting the parking lot. In the parking system shown in FIG. 1A, a cloud server performs the determination of direction and speed of vehicles.
Figure 7B:
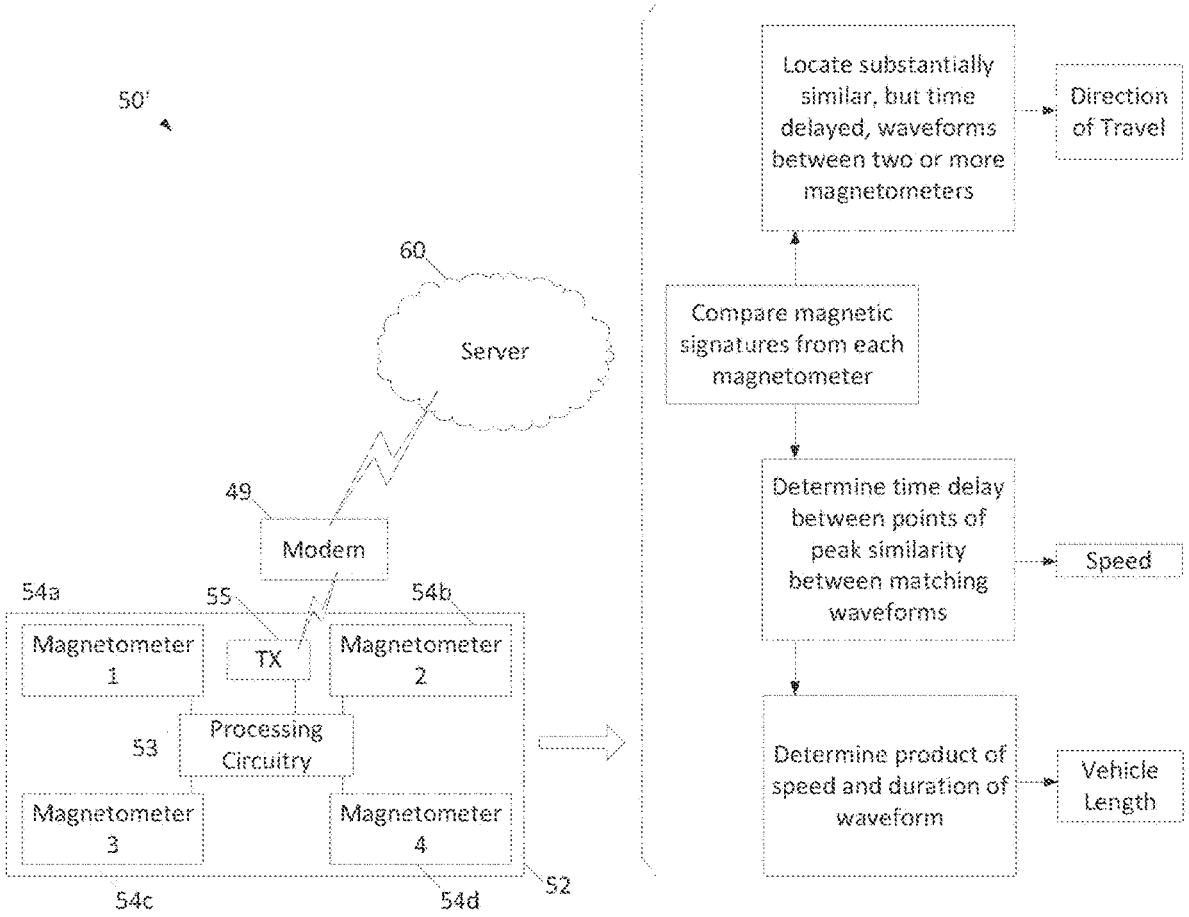
FIG. 7B is a block diagram of a parking system including vehicle sensors, the parking system being capable of determining the direction and speed of vehicles entering or exiting the parking lot. In the parking system shown in FIG.
Figure 8:
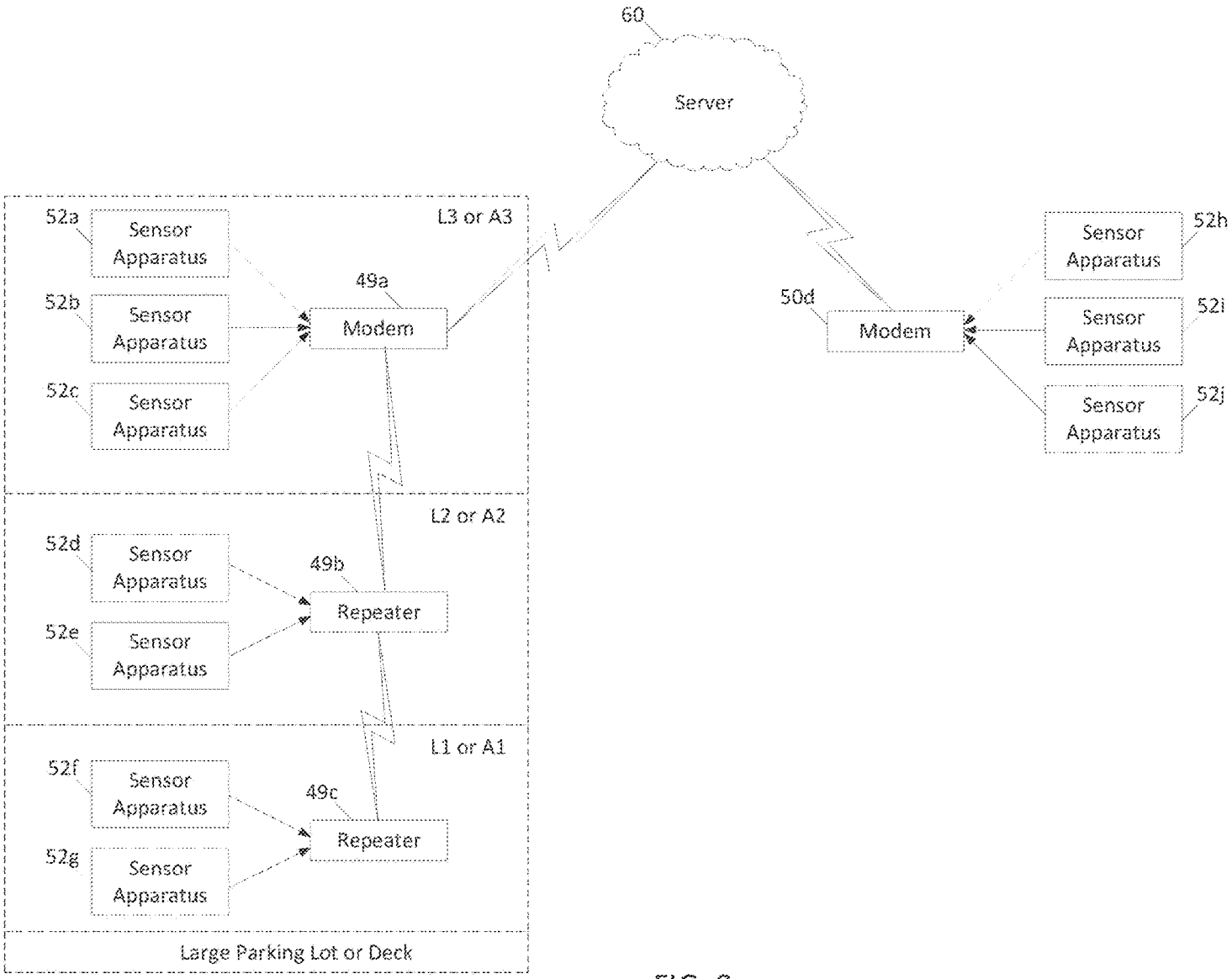

FIG. 8 is a block diagram showing possible network topologies for the parking system of FIGS. 7A-7B as installed in different kinds of parking lots.

Figure 9:
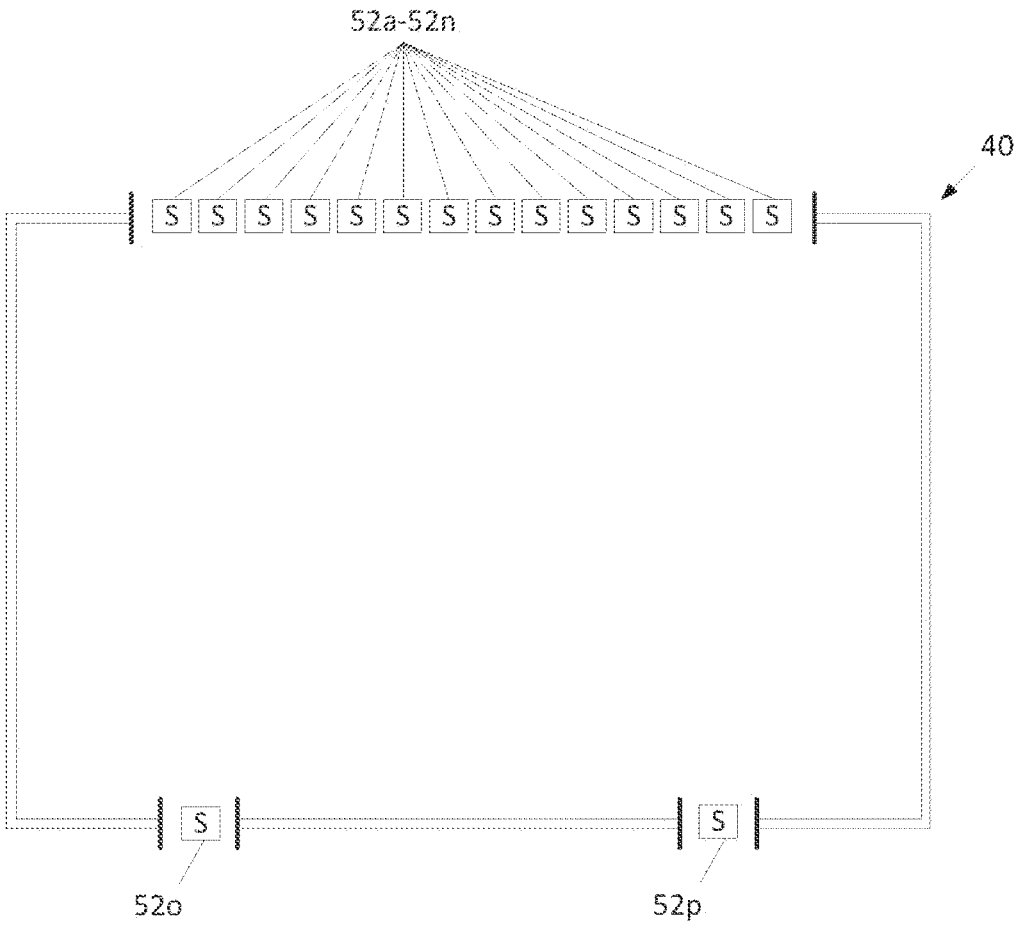

FIG. 9 is a top down view of a parking lot showing potential installation locations of the parking sensors and modems of FIGS. 7A-7B, and 8.

Figure 10:
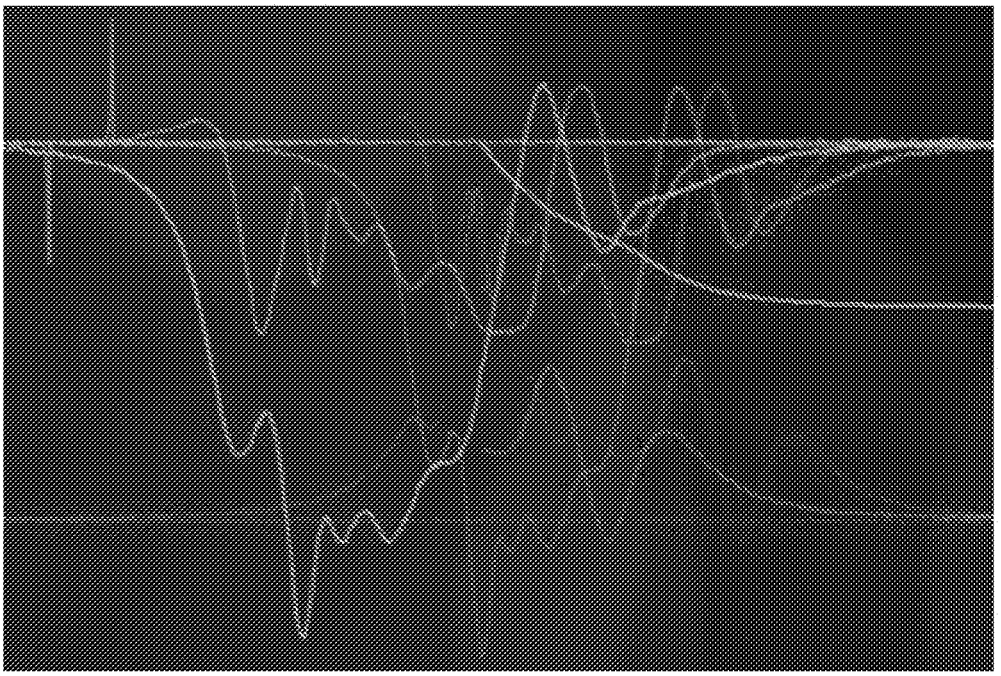

FIG. 10 is a graph showing magnetic signatures of a Toyota 4Runner that are delayed with respect to one another.

Figure 11:
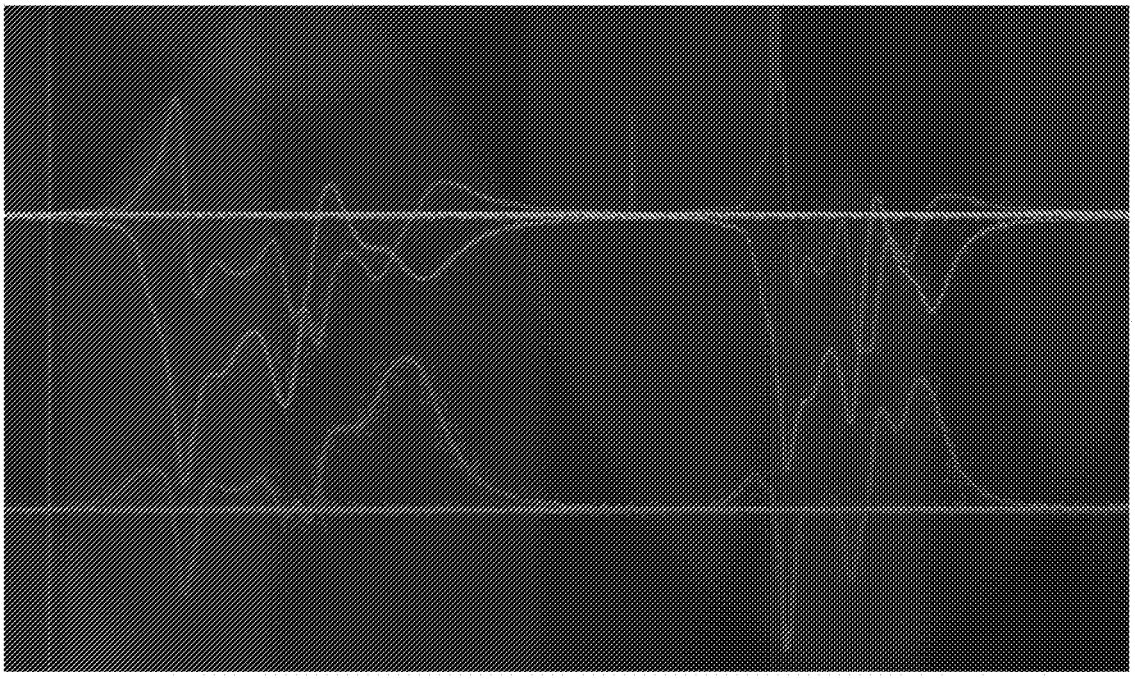

FIG. 11 is a graph showing magnetic signatures of a Ford F-150 that are delayed with respect to one another.

Figure 12:
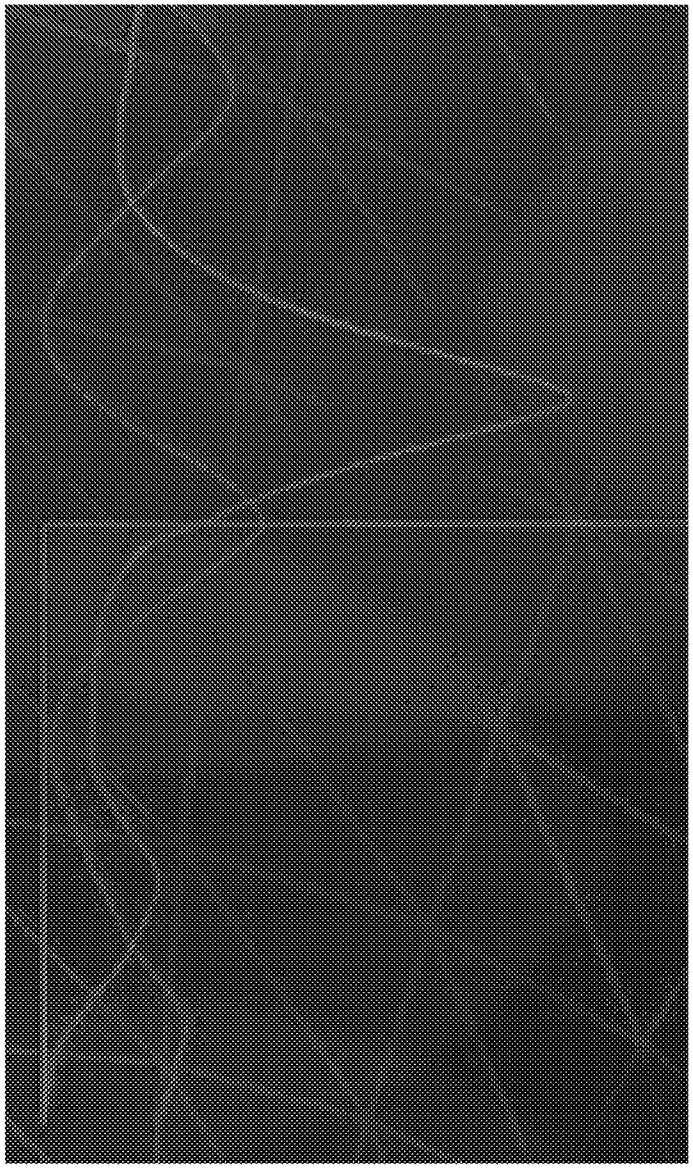

FIG. 12 is a graph showing points of peak similarity between magnetic signatures and the delay between those points of peak similarity.

Figure 13:
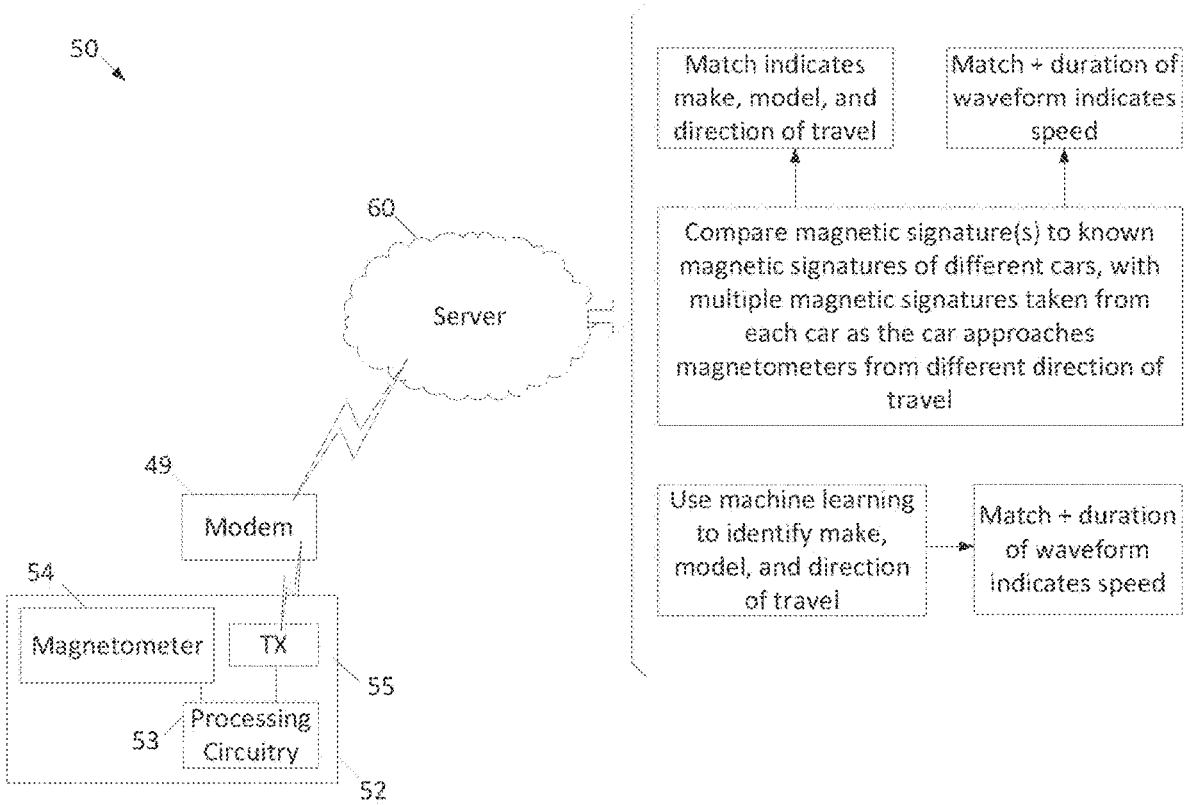

FIG. 13 is a block diagram of a parking system including a vehicle sensor, the parking system being capable of determining the make and model of vehicles entering or exiting the parking lot. In the parking system shown in FIG. 1A, a cloud server performs the determination of the make and model of the vehicles.

DETAILED DESCRIPTION

In the following description, numerous details are set forth to provide an understanding of the present disclosure. It will be understood by those skilled in the art, however, that the embodiments of the present disclosure may be practiced without these details and that numerous variations or modifications from the described embodiments may be possible.

Figure 1A:
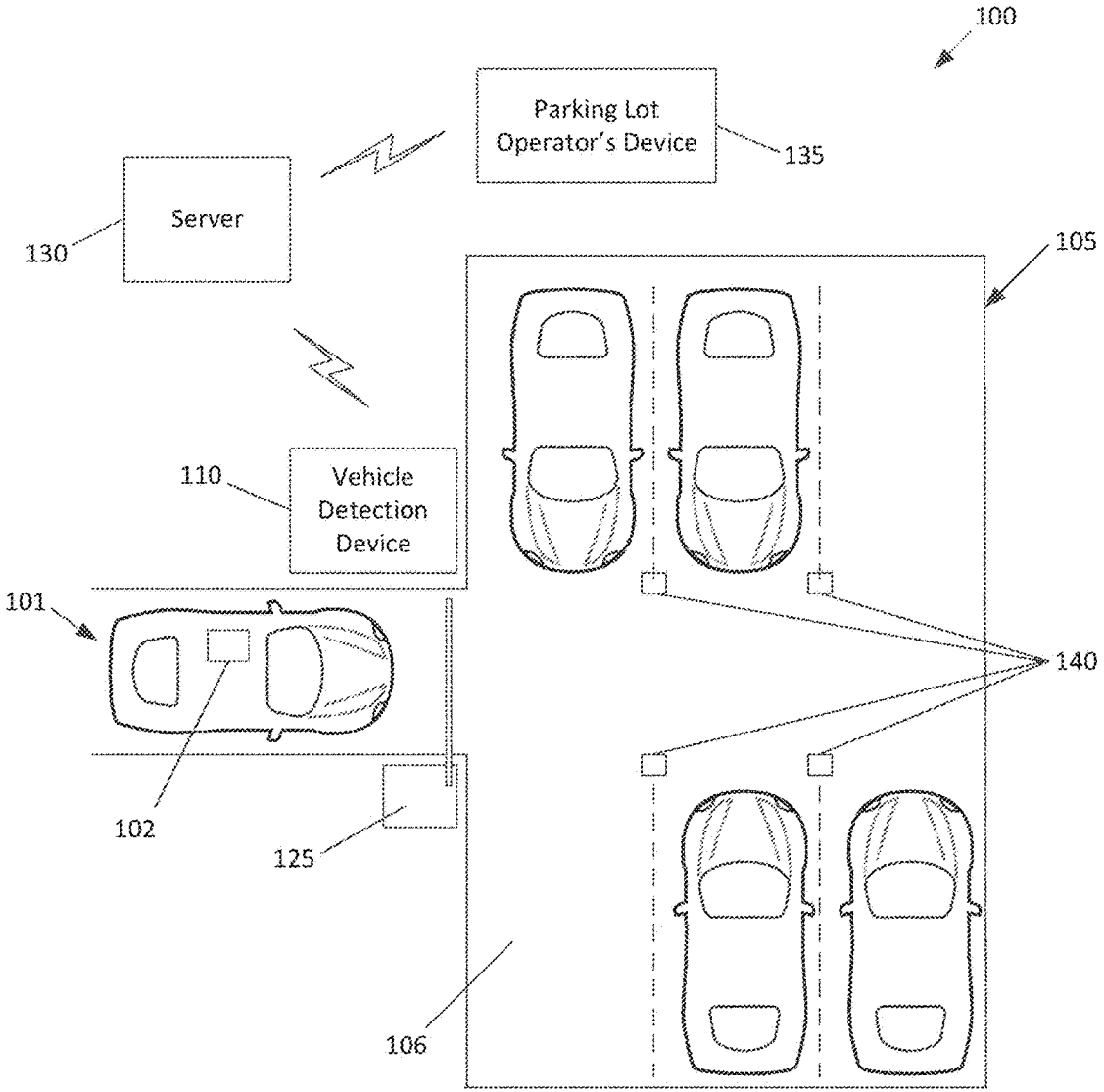
FIG. 1A is a block diagram of a system for monitoring arrival of vehicles, as installed at a parking lot, in accordance with the present disclosure.

With reference to FIG. 1A, a system 100 for monitoring arrival of vehicles is now described. The system 100 is installed at a parking lot 105, at which motor vehicles, such as cars, trucks, and motorcycles may be parked. A vehicle detection device 100 detects arrival of vehicles and/or entry of vehicles and/or departure of vehicles to or from the parking lot 105. As show, a vehicle 101 is adjacent a motor operated gate 125 selectively that permits vehicles to enter and depart from the parking lot 105. A server 130 is in communication with the vehicle detection device 110 over a network, such as the Internet, and receives data from the vehicle detection device 110. The server 130 processes this data 130, and may then send output to, or prompt for input from, a device of an operator of the parking lot 135, or a device 102 within the vehicle 101. Optional sensors or indicators 140 are installed adjacent parking spots 106.

The device 102 within the vehicle 101 may be a mobile wireless communications device utilized by the driver or passenger of the vehicle 101, such as a smartphone, smartwatch, or tablet, or may be a device integrated within the vehicle 101, such as an infotainment system.

Figure 4A:
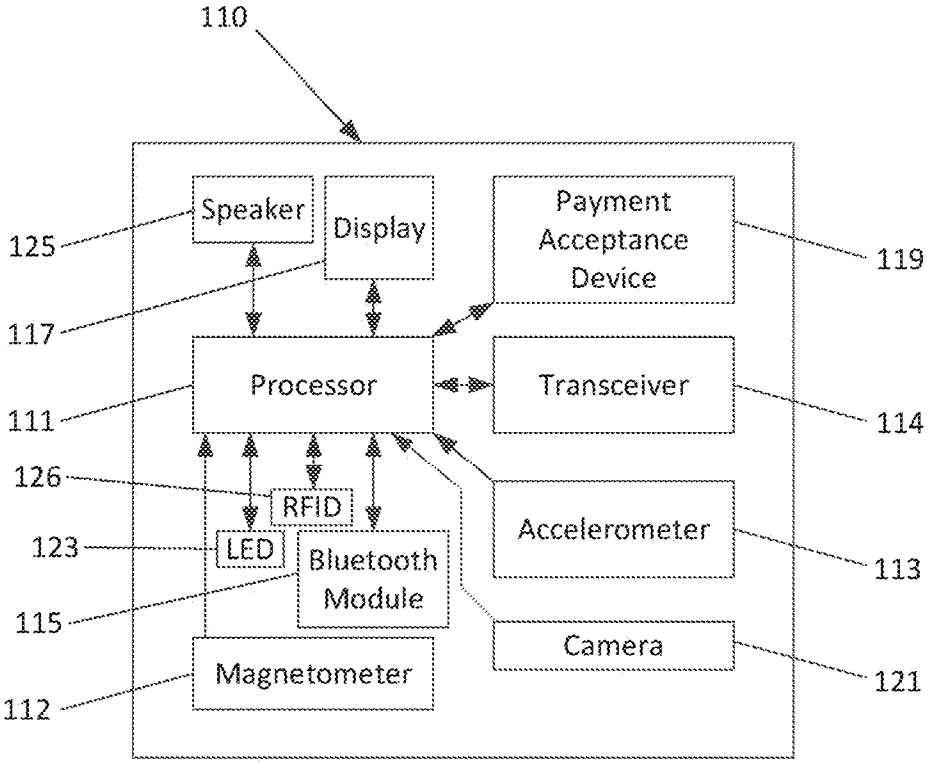
FIG. 4A is a block diagram of a vehicle detection device such as may be used with the systems shown in FIGS. 1-3.

With additional reference to FIG. 4A, further details of the vehicle detection device 110 will now be given. The vehicle detection device 110 includes a processor 111, such as a microprocessor or system on a chip. Coupled to the processor 111 is a magnetometer 112, as well as an accelerometer 113. A Bluetooth module 115 is coupled to the processor 111 for potential communication with the device 102 within the vehicle 101, and a transceiver 114 is coupled to the processor 111 for communication with the server 130 over the wide area network, and/or also with other vehicle detection devices 110 if present, and/or also with the optional sensors 140. A display 117, LED 123, and speaker 125 are coupled to the processor 111 for providing visual or audio output to a user. The display 117, LED 123, and speaker 125 may be utilized for any provided output described below instead of the device 102. A camera 121 is coupled to the processor 111 for taking pictures, such as of the license plate of the vehicle 101, which may be sent to and processed by the server. A payment acceptance device 119 is coupled to the processor 111 for accepting payment from a user. The payment acceptance device 119 may utilize magnetic strip, chip and pin, NFC, or other electronic payment acceptance technologies. In addition, the payment acceptance device 119 may also directly accept hard currency, such as bills and coins. A RFID reader 126 is coupled to the processor 111 for reading RFID tags associated with the vehicle, such as a toll tag mounted in the vehicle, or RFID tags within the tires of the vehicle.

A payment acceptance device 119 is coupled to the processor 111 for accepting payment from a user. The payment acceptance device 119 may utilize magnetic strip, chip and pin, NFC, or other electronic payment acceptance technologies. In addition, the payment acceptance device 119 may also directly accept hard currency, such as bills and coins. It should be appreciated that in some applications, the payment acceptance device 119 may be part of, or may be, the RFID reader 126.

The magnetometer 112 serves to sense metal in vehicles 101 via a change in the local magnetic field, and can thus detect the presence of vehicles 101. The processor 111 may be able to interpret reading from the magnetometer 112 to estimate the dimensions of the vehicle 101, from which a type or configuration of the vehicle may be inferred (i.e. a vehicle estimated to be a car, whereas a larger vehicle is likely to be a truck).

The accelerometer 113 serves to detect vibrations in multiple axes, such as those caused by a passing vehicle 101, and can therefore be used to determine whether the vehicle 101 is entering or leaving the given area. By logging the magnitude and direction of vibrations detected by the accelerometer 113, the processor 111 can infer both the speed of the vehicle, as well as whether the vehicle is arriving or departing.

Due to the use of the accelerometer 113 and magnetometer 112 for detecting vehicles 101, the vehicle detection device 110 is positioned at the entrance and exit to the parking lot 105, and needs not be driven over by the vehicle 101 in order for detection to occur.

As stated, the RFID reader 126 may read RFID tags associated with the vehicle. Thus, the RFID reader 126 may read a code from the RFID tag, and the code may be a toll tag ID number, or may be a tire identification code. Where the code is a toll tag ID, the information about the vehicle may be the toll tag ID, which may in turn be used for identification of the user by looking up the user's information in a table of toll tag ID's, or in processing payment via the toll tag ID. Where the code is a tire identification code, the information about the vehicle may be the tire identification code, which may in turn be used by the server to determine a make and model of the tires on the vehicle, which may in turn be used to determine the type of vehicle and vehicle configuration, as well as the make and model of the vehicle. Also, the information about the vehicle may include the various measurements taken by the accelerometer 113 and magnetometer 112 as well as the make and model of the tires, which may be used to more accurately determine the type of vehicle and vehicle configuration, as well as the make and model of the vehicle.

As stated above, using the transceiver 114, the vehicle detection device 110 may communicate with other vehicle detection devices 110. In addition, one vehicle detection device 110 may act as a relay for another vehicle detection device 110, transmitting information received therefrom to the server 130, or to the device 102 within the vehicle 101. The transceiver 114 may also be used by the vehicle detection device 110 for communication with a fixed or mobile device used by a parking lot attendant, such as a smartphone, tablet, or pay station.

The processor 111 may also cooperate with additional vehicle detection hardware, such as a pressure sensor for vehicle sensing, allowing retrofitting of the vehicle detection device 110 to existing parking lot management installations. In addition, the processor 111 may also cooperate with hardware, such as RFID readers, that read toll tags or toll passes, and/or Bluetooth connections from which vehicle information may be read, and via which payment for parking may be effectuated.

Figure 1B:
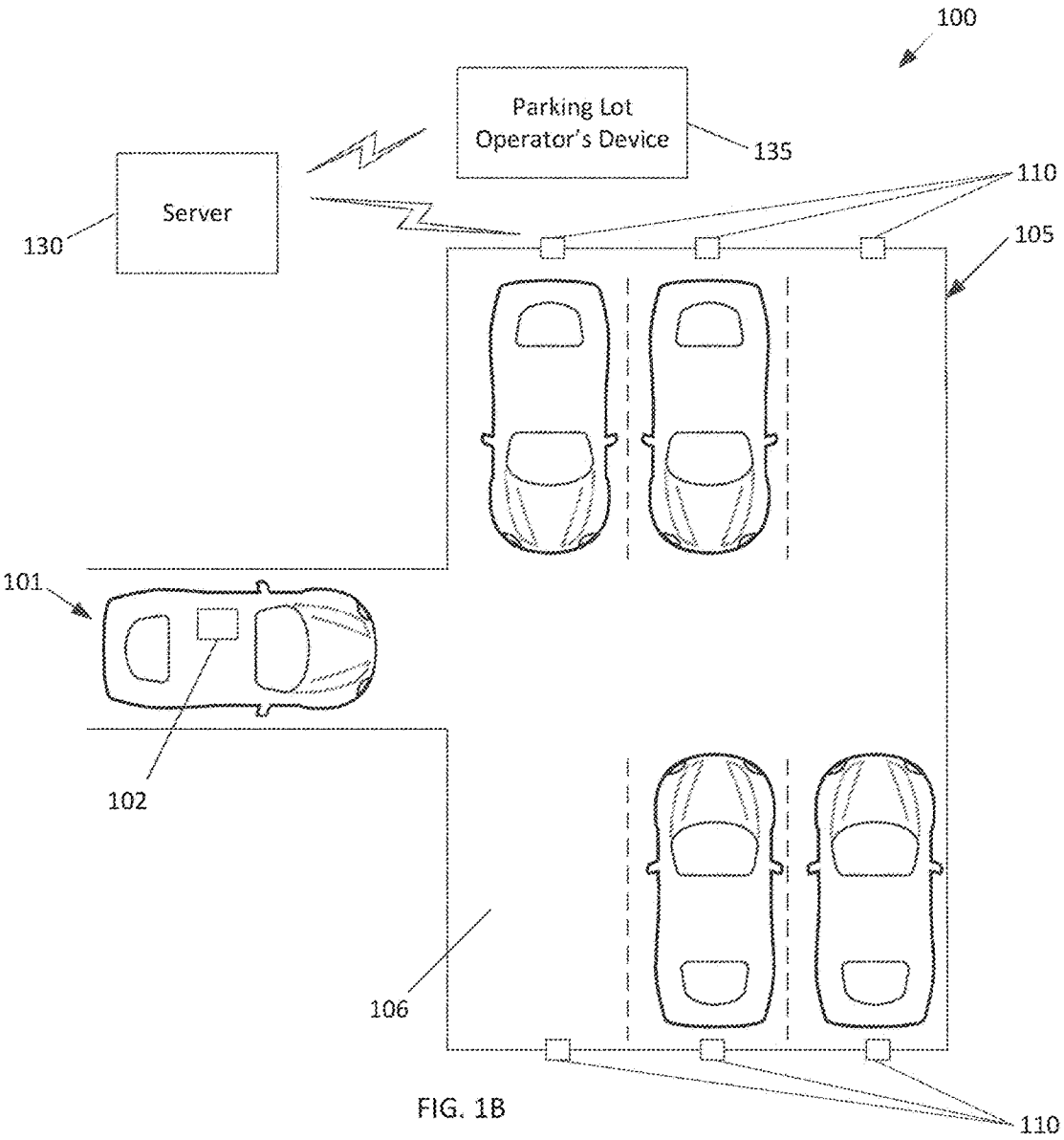
FIG. 1B is a block diagram of a different embodiment of a system for monitoring arrival of vehicles, as installed at a parking lot, in accordance with the present disclosure.

In some applications, such as that shown in FIG. 1B, rather than the vehicle detection device 110 being at the entrance to the parking lot 105, there is a separate vehicle detection device 110 located in each parking space 106. Each of these vehicle detection devices 110 may have the components as described above and below, and may operate as described above and below. In addition, it should be understood that the various vehicle detection devices 110 may communicate with one another via their transceivers 114, their Bluetooth modules 115, or a combination thereof. This communication may be to relay data to and from the server 130, for example. In addition, the various vehicle detection devices 110 may cooperate using their Bluetooth modules 115 to perform triangulation to determine the position of the vehicle 101 within the parking lot 105, and may then direct the driver of the vehicle 101 to the parking space 106 via the device 102 within the vehicle 101, or via their respective displays 117, LEDs 123, and/or speakers 125.

Figure 1C:
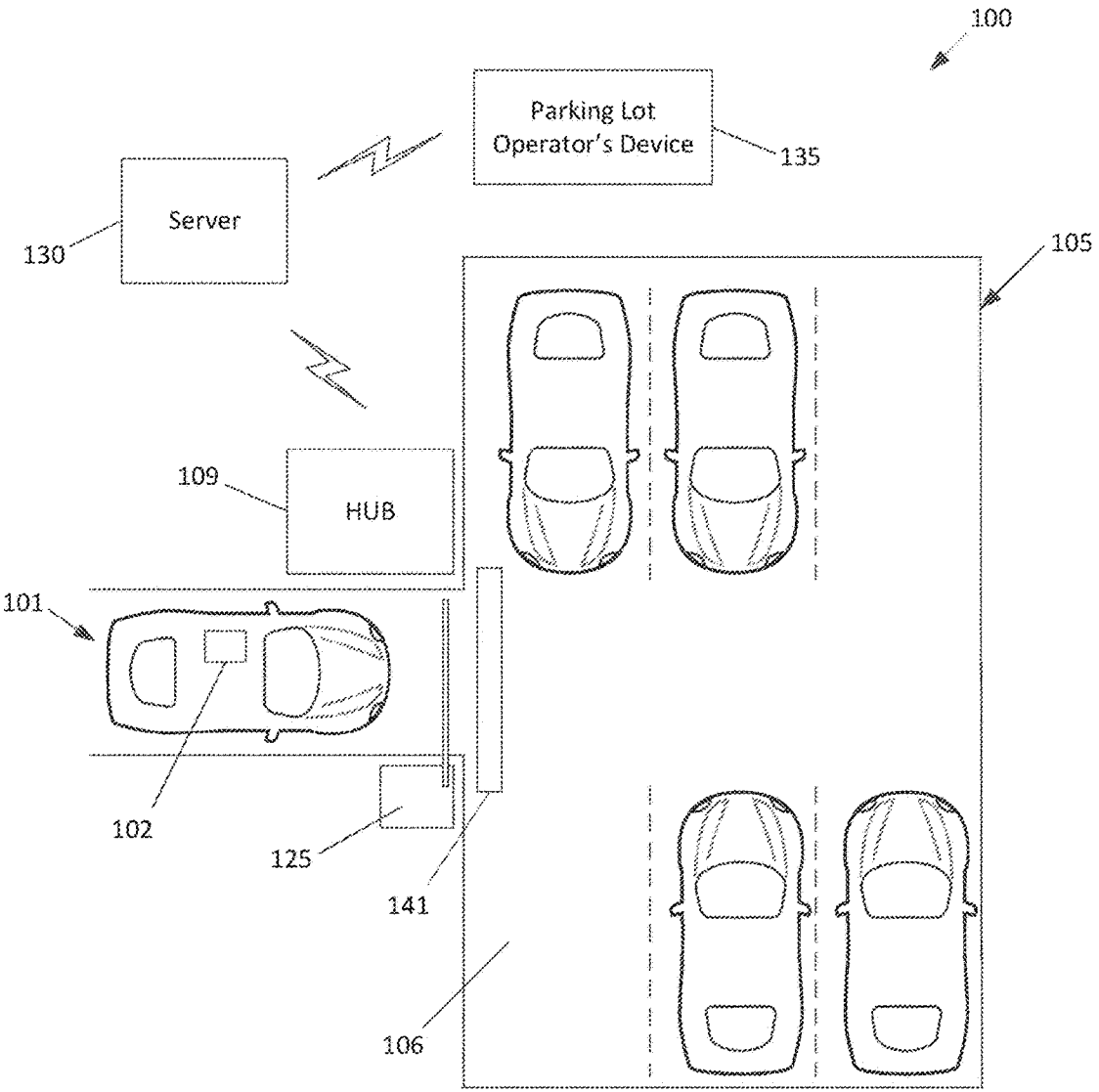
FIG. 1C is a block diagram of a further embodiment of a system for monitoring arrival of vehicles, as installed at a parking lot, in accordance with the present disclosure.
Figure 1D:
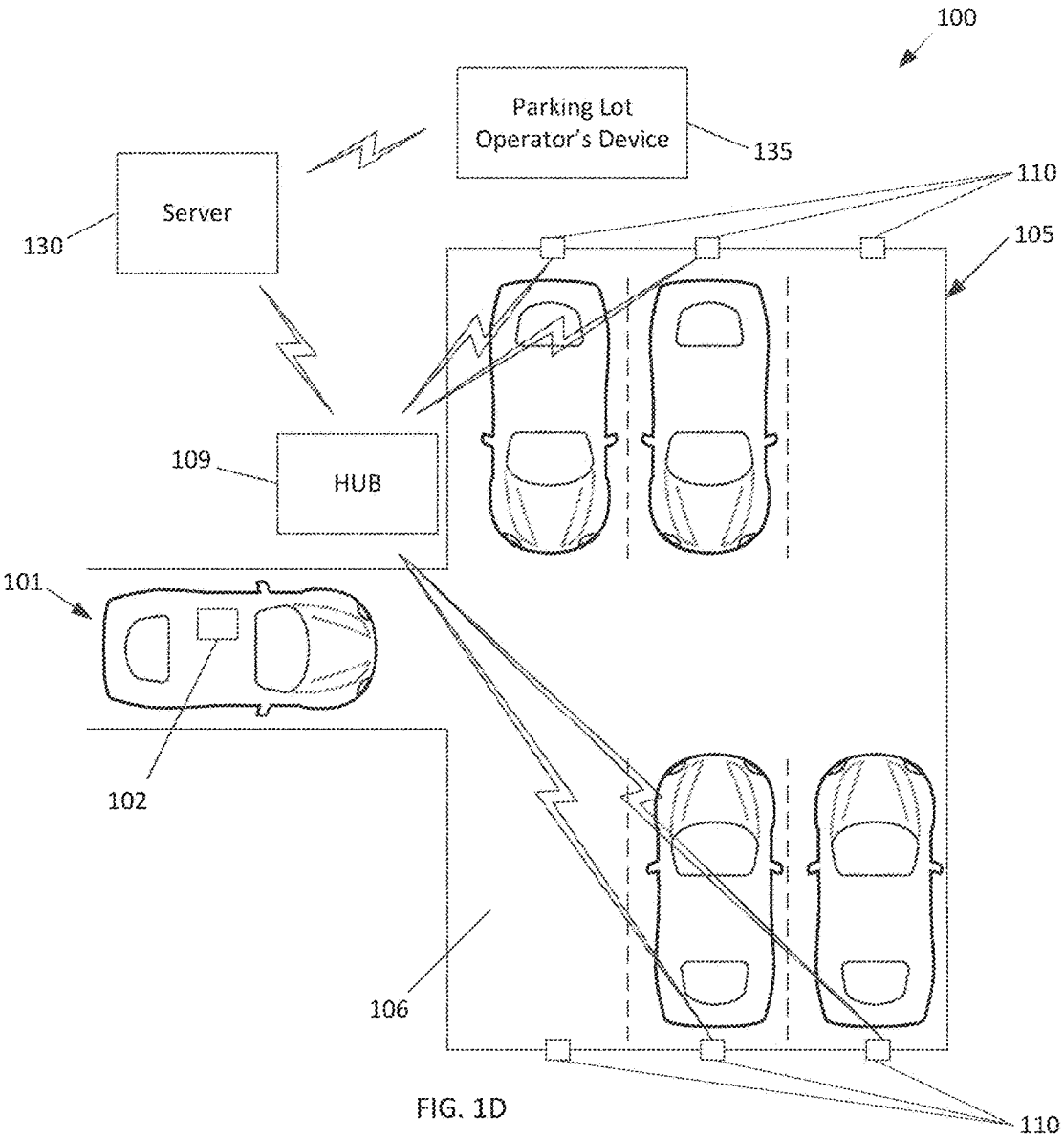
FIG. 1D is a block diagram of an additional embodiment of a system for monitoring arrival of vehicles, as installed at a parking lot, in accordance with the present disclosure.

In other applications, such as that shown in FIG. 1D, rather than directly communicating with the server 130, each vehicle detection device 110 communicates with a hub 109 either wirelessly or over a wire, and the hub 109 in turn communicates with the server 130, serving to pass data to the server 130 from the vehicle detection devices 110, and serving to pass data to the vehicle detection devices 110 from the server 130. It should also be appreciated that the hub 109 may perform any of the functions described above or below as being performed by the vehicle detection device 110.

Figure 5:
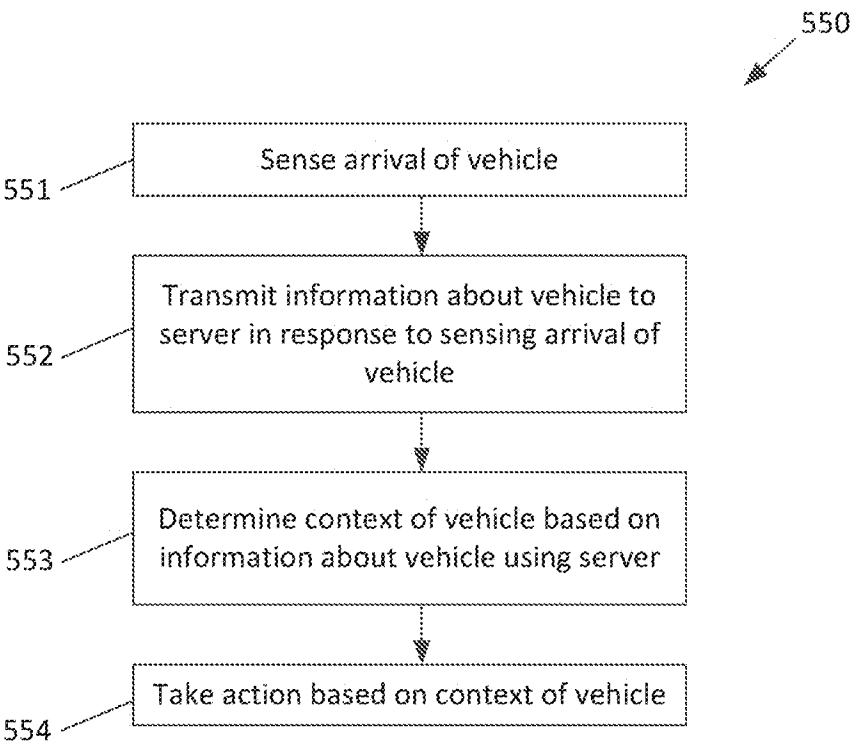
FIG. 5 is a flowchart of a method of monitoring arrival of vehicles, in accordance with the present disclosure.

With additional reference to the flowchart 550 of FIG. 5, a method of monitoring vehicle 101 arrival to a given location, such as a parking lot 105, is now described. The vehicle detection device 110, as described above, operates to sense arrival (or departure) of a vehicle 101 (Block 551). The vehicle detection device 110 then sense information about the vehicle 101, and sends it to the server 130 in response to the sensing of arrival or departure (Block 552). The information about the vehicle may be sensed via the magnetometer 112 and accelerometer 113, and/or may be sensed via interaction with the device 102 within the vehicle 101 via the Bluetooth module 115, or via the transceiver 114.

Next, the server 130 determines a context of the vehicle 101 based on the information received from the vehicle detection device 110 (Block 553). Thereafter, the server 130 takes at least one action based on the context of the vehicle 101 (Block 554).

Through sensing different types of information about the vehicle 101, through determining different contexts, and through taking different actions, the system 100 may be used in a wide variety of applications. For example, the application shown in FIG. 1A is that where the system 100 is installed at a parking lot 105.

A first parking related application is where a driver of the vehicle 101 has prepaid for parking via the device 102. When the vehicle 101 arrives to the parking lot 105, the vehicle detection device 110 operates to read the prepayment (or voucher) information from the device 102, or serves to identify the vehicle 101 via the device 102 and then query the server 130 for the prepayment or voucher information. If the prepayment or voucher is valid (i.e. has been properly paid for the correct amount, and/or if it is an authorized time of day, date, or day of the week), the vehicle detection device 110 or server 130 instructs the gate 125 to open, and updated parking lot inventory information is sent to the parking lot operator's device 135.

If no prepayment is present, or if the prepayment or voucher is not valid for the present time, the vehicle detection device 110 may, either on its own via its display 117, LED 123, and speaker 125, or via the device 102 in the vehicle 101, demand payment for the right to park the vehicle 101 in the parking lot 105. If, within a given amount of time, the payment is not received (from either the device 102, or in pieces from multiple devices 102, or via the payment acceptance device 119) and the vehicle 101 has not left the parking lot, the vehicle detection device 110, either on its own or via the server 130, may notify the parking lot operator's device 135 that the vehicle 101 is parked in the parking lot 105 without having paid for the right to do so.

In a second parking related application, the vehicle detection device 110 serves to detect the number of devices 102 in the vehicle 101, and transmits that information to the server. Since the majority of adults carry a smartphone in today's world, from this number of devices 102 in the vehicle 101, the server 130 can estimate the number of people in the vehicle 101, and may transmit this data to the parking lot operator's device 135, may save this data for future analytics, or may transmit this data to other devices, such as those within a venue adjacent the parking lot 105.

In a third parking related application, the vehicle detection device 110 serves to read user identity information from the device 102 in the vehicle, or to request user identity information associated with the device 102 from the server 130. Then, the server 130 can notify the parking lot operator or venue that the user matching the user identity information has arrived. Therefore, the parking lot operator or venue can prepare for the arrival of that specific user.

As an example, the specific user may have reserved a given parking space 106, and the parking lot operator may manually (via a human attendant) direct the vehicle 101 to park in the parking space 106, or the server 130 may direct the vehicle 101 to park in the parking space 106 via displays incorporated with the sensors 140, or via the display 117, LED 123, and/or speaker 125. In addition, in some applications, the sensors 140 may report to the parking lot operator, the vehicle detection device 110, or the server 130 which spaces are occupied. This functionality may also be performed by the vehicle detection device 110. If the vehicle detection device 110, via the sensors 140 or on its own, determines that the reserved space 106 has been improperly occupied (i.e. the space 106 is occupied, but the vehicle detection device 110 has not detected the device 102 of the specific user), the vehicle detection device 110 may directly or via the server 130 notify the parking lot operator's device 135 that the parking space 106 is occupied by an unauthorized vehicle.

In any such parking applications wherein payment is collected for the parking space 106, the vehicle detection device 110 may determine both an arrival time and a departure time of the vehicle 101, and the payment amount may be based upon the length of time between the arrival time and departure time. The payment amount may be additional or alternatively be based upon the time of day, date, or day of week of the arrival time and/or departure time—for example the payment may be greater on a Saturday than on a Tuesday, or may be less at 2:00 AM than at 9:00 AM. In addition, the payment amount may be dependent upon the weight, type, or configuration of the vehicle 101 (e.g. vehicle size, vehicle weight, vehicle body style, etc), as determined based on readings from the magnetometer 112 and/or accelerometer 113.

In some cases, the vehicle 101 may be authorized to park in the parking lot 105 at the time of parking, but may at a later point in time, before departure, become no longer authorized. For example, the parking lot 105 may be operated by a municipality, and may need to be emptied for street cleaning, trash pickup, etc. In such cases, the server 130 may notify the parking lot operator's device 135 (and thus the municipality's device) that certain vehicles have not yet departed. The municipality can then take appropriate action. In some cases, such notification may additional or alternatively be sent to the device 102.

Another parking application may be where the parking lot 105 is a valet parking lot. The vehicle detection device 110 may this record a unique identifier for the vehicle when it entered the parking lot 105, and thus unique identifier may be transmitted, via the server 130 or directly, to the device 102. A user may request retrieval of the vehicle 101 via provided input to the device 102.

Figure 2:
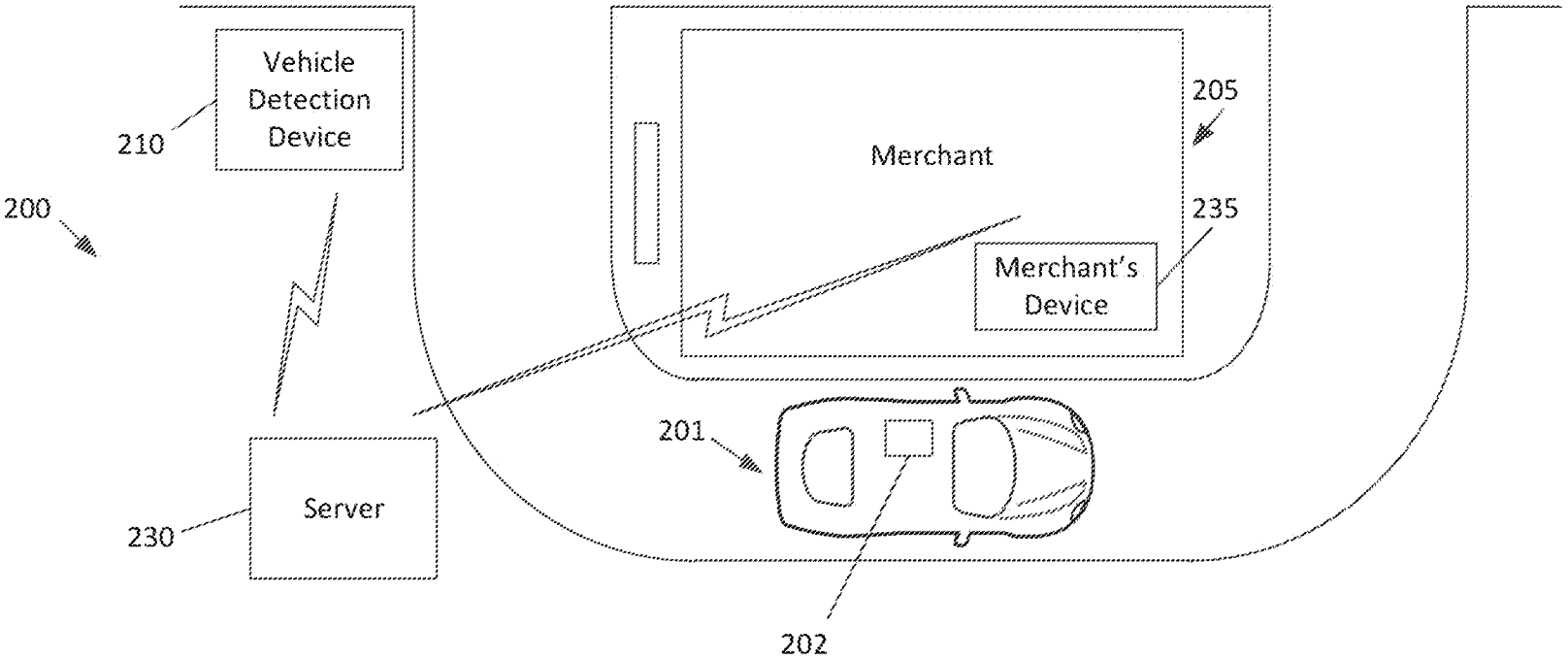
FIG. 2 is a block diagram of a system for monitoring arrival of vehicles, as installed at a merchant, in accordance with the present disclosure.

Another application for the system 200 in which the system 200 is employed at a merchant is now described with additional reference to FIG. 2. Here, the parking lot 205 is a parking lot for a merchant, such as a restaurant, and 205 may be a drive through lane instead of a parking lot. The vehicle detection device 210 can detect when the vehicle 201 arrives at the merchant, and can read the identity of a user from the device 202, or request an identity of the user from the server 230 based on information received from the device 202. The server 230 may then send the identity of the user to the merchant's device 235, which may retrieve order information for the user. In some applications, the server 230 may have the order information for the user, and may pass the order information along to the merchant's device 235. In yet another application, the vehicle detection device 210 may cause the device 202 to prompt the user to enter an order. The user's order may then be transmitted to a device inside the Merchant's business wherein it is prepared and delivered to the user. In the case of 205 being a drive through lane, the system 200 may compute the time required to prepare the user's order and, comparing such time to the time required to prepare other users' orders within the drive through lane, may direct the Merchant's employees to prepare orders in a sequence different from the sequence of vehicles in the drive through queue in an effort to minimize user wait times and maximize efficiency.

Figure 3:
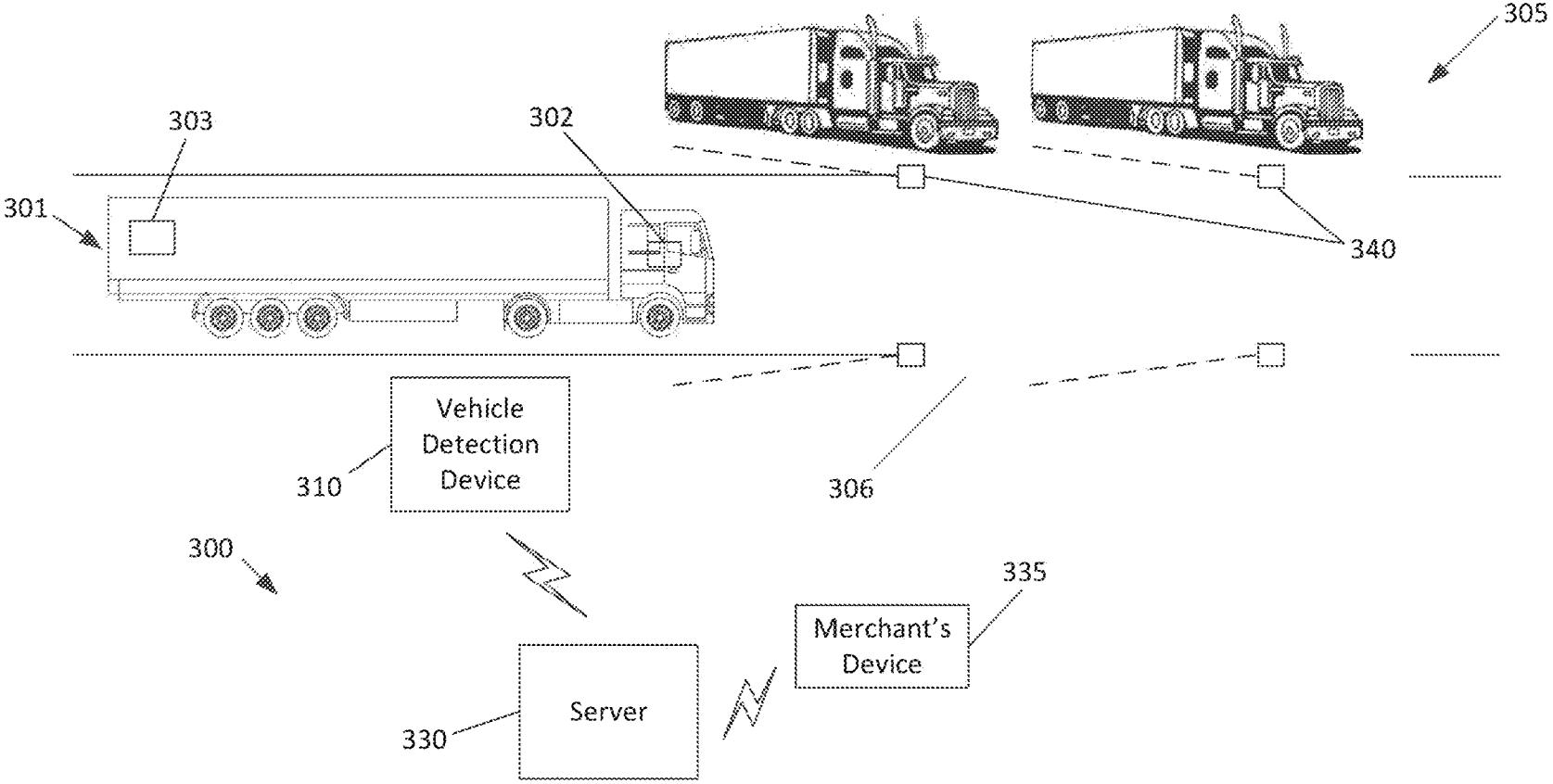
FIG. 3 is a block diagram of a system for monitoring arrival of vehicles, as installed at a shipping log, in accordance with the present disclosure.

Yet another application for the system 300 in which the system 300 is employed at a shipping yard is now described with additional reference to FIG. 3. Here, the parking lot 305 is for trucks 301 at a shipping yard. The vehicle detection system 310 may retrieve a shipping manifest from the device 302, server 330, or shipping yard's device 335, and pass the shipping manifest along to any such device. The server 330 or shipping yard's device 335, knowing that the shipment having that shipping manifest has arrived, may notify the owner of the cargo. The server 330 may, either directly or via the vehicle detection system 310, notify the device 302 or the sensors 306 to direct the driver where to park the truck.

Additional sensors 303 may be placed in the cargo containers carried by the trucks 301, and these sensors may detect when the cargo container is being moved (for example, from a 301 to storage), and transmit that data to the server 330 via the vehicle detection device 310. The server 330 may then report that data to the shipping yard's device 335.

Figure 4B:
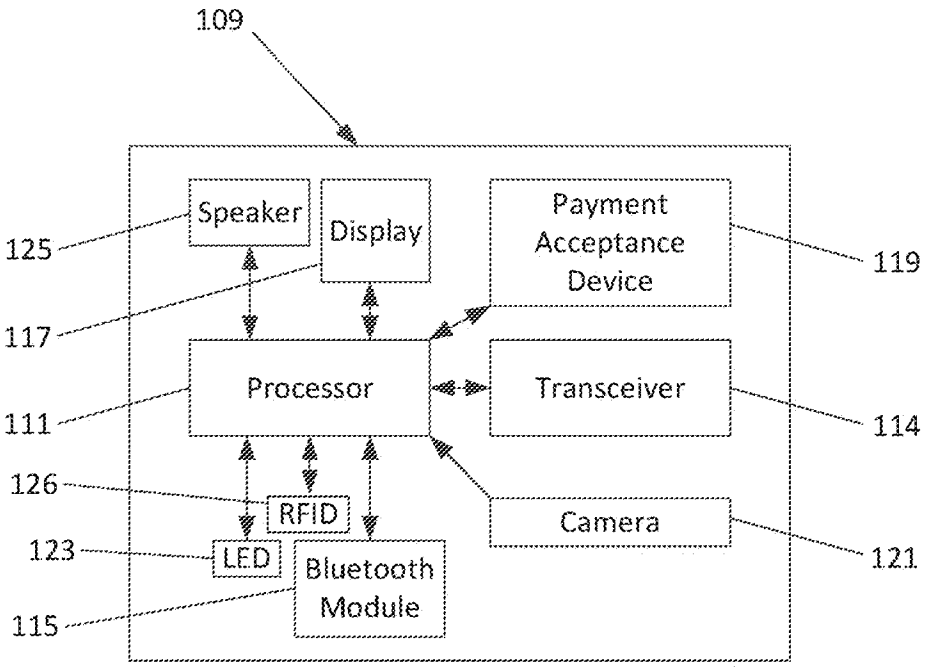
FIG. 4B is a block diagram of a hub device such as may be used with the systems shown in FIGS. 1-3.
Figure 6:
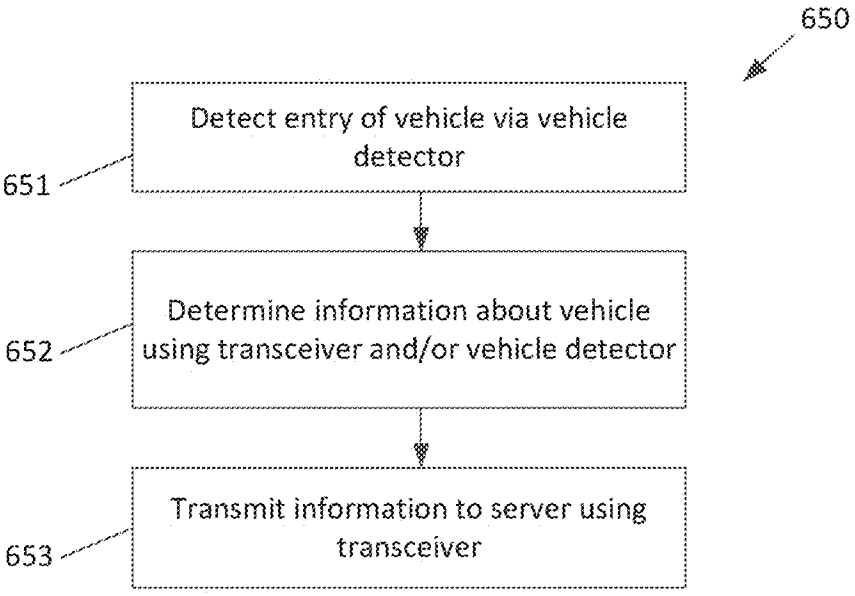
FIG. 6 is a flowchart of a method of operating the vehicle sensing device of FIG. 4A.

Further details of the vehicle sensing system 100 and vehicle sensing device 110 will now be given with reference to FIGS. 4 and 6. A method of operating the vehicle sensing device 110, described with reference to flowchart 650, includes detecting entry of the vehicle to the given area via the vehicle detector (e.g. magnetometer 112, accelerometer 113, etc) at Block 651. Thereafter, the method includes determining information about the vehicle, in response to sensing arrival of the vehicle to the given location, using the wireless transceiver 114 and/or the vehicle detector (e.g. magnetometer 112, accelerometer 113, etc) at Block 652. Then, the method continued with transmitting information to the server using the transceiver 114 at Block 653.

In some instances, the processor 111 may transmit an application trigger to cause the device within the vehicle (e.g. smartphone, infotainment system, etc) to launch an application. This application may prompt the user for payment, provide the user with notice that they are authorized or not authorized, provide the user with information about where to park, where to pick up cargo, or where to drop off cargo, provide the user with information about valet parking (such as price), or provide the user with information about an order from a merchant.

In some applications, for example such as the one shown in FIG. 1C, rather than a vehicle sensing device performing the above steps, a hub 109 works in accordance with a counting device 141 to perform the above functions. The hub 109 contains similar components to the vehicle sensing device described above, as is apparent from FIG. 4B, and has similar functionality to the vehicle sensing device as well, with the exception being that it lacks a magnetometer and accelerometer, and instead determines arrival and departure of vehicles via triggering of the counting device 141 by the weight of the vehicles driving over the counting device 141. It should be appreciated that the hub 109 may actually be a portable wireless electronic device, such as a smartphone or tablet.

With initial reference to FIGS. 7A-7B, a parking system 50 is now described. The parking system 50 includes one or more parking sensor apparatuses 52 situated at the entrance or exit lanes to a parking lot. Each parking sensor apparatus 52 includes, for example, four three-axis magnetometers 54*a*-54*d* positioned in a rectangular shape. The magnetometers 54*a*-54*d* are coupled to processing circuitry 53, such as an application specific integrated circuit. The processing circuitry 53 is coupled to a transmitter 55, which wirelessly communicates with modem 49. In some applications, such as that shown in FIG. 7A, the processing circuitry 53 converts signals received from the magnetometers 54*a*-54*d* into a format usable by cellular modem 49 for transmission to a cloud based server 60. In other applications, such as that shown in FIG. 7B, the processing circuitry 53 processes the signals received from the magnetometers 54*a*-54*d* to determine the properties of vehicles driving over the parking sensor apparatus 52 (such as speed, direction, length, etc.) and sends those determined values to the cloud based server 60.

Which configuration is used for a given installation may depend on the particular details of that installation. For example, if the parking sensor apparatus 52 and cellular modem 49 is to be powered by a battery, using the processing circuitry 53 to determine the properties of the vehicles so as to reduce the amount of data sent by the cellular modem 49 may help provide for greater battery life over sending the signals from the magnetometers 54*a*-54*d* to the cloud based server 60. On the other hand, where battery life is not a concern, it may be desirable for the cloud based server 60 to determine the properties of the vehicles so as to allow for easy updating of the analysis techniques used, as well as for additional data processing power.

The magnetometers 54*a*-54*d* may each have analog to digital conversion circuitry associated therewith (not shown), or packaged therewith (not shown), that sends data to the processing circuitry 53 directly or over a bus connection.

It should be understood that although the modem 49 has been described as a cellular modem, it may in some cases instead be a wireless network transceiver (e.g. WiFi), or may be a wired network interface (e.g. Ethernet).

In operation, a vehicle drives over the parking apparatus 52, and each magnetometer 54*a*-54*d* of the parking apparatus 52 repeatedly produces a waveform corresponding to magnetic features, or a magnetic signature, of the vehicle, at a rate of, for example, 50 times per second to 800 times per second. The Inventor has found that the specific waveforms produced for different vehicles are influenced by unpredictable factors, making extraction of information directly from the waveforms to be difficult. However, the Inventor has also found that the specific waveforms produced by a given vehicle are consistent across the magnetometers 54*a*-54*d*. Therefore, by comparing the waveforms produced by the magnetometers 54*a*-54*d* to one another while varying an applied time offset, in response to a car driving over the parking apparatus 52, the direction and speed of the vehicle may be determined.

The server 60 may perform the above mentioned comparisons (FIG. 7A), or the processing circuitry 53 may perform the above mentioned comparisons (FIG. 7B). Since each magnetometer 54*a*-54*d* produces numerous magnetic signatures of the vehicle as it drives over, each waveform from each magnetometer 54*a*-54*d* is compared to each waveform from each other magnetometer 54*a*-54*d* while a variable time offset therebetween is adjusted so as to locate a match. Examples of such comparisons are shown in FIGS. 10-11, with FIG. 10 showing magnetic signatures for a Toyota 4Runner SUV, and FIG. 11 showing magnetic signatures for a Ford F-150.

When two waveforms from adjacent magnetometers (from among 54*a*-54*d*) are substantially similar or identical, and not time shifted with respect to one another (and thus, little to no offset is needed), this indicates that the vehicle has driven across those magnetometers in a same direction. However, when two waveforms from adjacent magnetometers (from among 54*a*-54*d*) are substantially similar or identical, as well as being time shifted with respect to one another (thus, offset is needed to produce the match), this indicates that the vehicle has driven in a direction from the magnetometer producing the earlier in time version of the waveform to the magnetometer producing the later in time version of the waveform. For example, if the waveforms produced by magnetometers 54*a* and 54*b* are substantially similar or identical, with the waveform produced by magnetometer 54*b* being delayed with respect to the waveform produced by magnetometer 54*a*, then the direction of the vehicle is in a direction from magnetometer 54*a* to magnetometer 54*b*.

Using this information, the server 60 can accurately maintain a count of the number of vehicles in the parking lot, even when a vehicle enters through a designated exit, exits through a designated entrance, or enters or exits through an undefined area serving as both entry and exit. Where the direction of the vehicle indicates that the vehicle is leaving the parking lot, the count of the number of vehicles in the parking lot is decremented by the server 60; likewise, where the direction of the vehicle indicates that the vehicle is entering the parking lot, the count of the number of the vehicles in the parking lot is incremented by the server 60.

In addition, using such a system 50, a parking lot can utilize undesignated entrances and exits, permitting for quicker traffic flow in some scenarios (i.e. all act as entrances at a stadium prior to a sporting event, and all act as exits at the stadium after the sporting event) while still allowing for automated monitoring of parking inventors. Or, the parking lot may have a combination of defined and undefined entrances and exists. Such a configuration is shown in FIG. 9, where the parking lot 40 includes sensor apparatuses 52*o* and 52*p* located at defined single lane entrances or exits, and with sensor apparatuses 52*a*-52*n* located at a wide open undefined area through which vehicles may enter and exit.

It should be understood that by identifying and analyzing points of peak similarity between similar but time delayed waveforms and determining the time delay, the server 60 or processing circuitry 53 may determine the speed of the vehicle. For example, speed can be calculated as distance/time, the distance between the various magnetometers 54*a*-54*d* is known. Therefore, as an example, the speed may be calculated as the distance between the magnetometers (from among 54*a*-54*d*) that generated a pair of similar yet time delayed with respect to one another waveforms, divided by the time delay between peak values of those waveforms. Using points of peak similarity, such as peak values, zero crossings, or other readily identifiable features for delay comparisons allows for a more precise match between the waveforms than simply using a beginning or end of the waveform for the delay comparisons. A graph showing points of peak similarity between magnetic signatures and the delay between those points of peak similarity is shown in FIG. 12, where the X axis corresponds to time-delays where peak similarities have occurred between compared magnetic signatures, and where the Y axis corresponds to the degree of that similarity.

Additionally, the determined speed of the vehicle may be used in further calculations. For example, the server 60 or processing circuitry 53 may estimate a length of the vehicle as a product of the determined speed and a duration of the waveform. From the estimated length, the server 60 may then estimate whether the vehicle is a car, truck, SUV, or commercial vehicle by comparing the length to a series of threshold sizes. The server 60 may determine the vehicle to be a commercial vehicle if the length is greater than an upper threshold, may determine the vehicle to be a truck or SUV if the vehicle's length is greater than or equal to a middle threshold and less than the upper threshold, and may determine the vehicle to be a car if the vehicle's length is greater than or equal to a lower threshold and less than the middle threshold length. In some cases, the server 60 may use upper and lower threshold lengths, with the vehicle length being greater than the upper threshold meaning that the vehicle is a commercial vehicle, and the vehicle length being greater than or equal to a lower threshold and less than the upper threshold meaning that the vehicle is a private vehicle.

Indeed, it should be appreciated that any suitable thresholds, number of thresholds, and comparison operators may be used.

It should also be appreciated that this functionality can be used to reject a waveform as representing a false positive, such as where the vehicle length is less than the lower threshold. This may mean that a pedestrian carrying a metallic object, or riding a metallic object such as a wheelchair, mobility cart, or bicycle has passed over the sensor apparatus 52, and thus should not be counted in the determination of parking lot space inventory.

It should be understood that although the parking apparatus 52 as shown includes four magnetometers 54*a*-54*d* arranged into a rectangular shape, other numbers of magnetometers and other shapes may be used. Indeed, there may be two, three, five, six, or any suitable number of magnetometers arranged into any usable shape.

As an example, there may be two magnetometers spaced apart from one another. This design may be suitable for entrances and exits to parking lots where physical barriers ensure that vehicles will drive over the magnetometers in either a forward or a reverse direction, and not at other angles. As another example, three magnetometers may be arranged into a triangular shape. This arrangement may be suitable for entrances and exits to parking lots without physical barriers restricting the movement of vehicles, such that vehicles may drive over the magnetometers from multiple different directions. However, depending on the specific triangular arrangement and the placement of the parking apparatus at the parking lot, the same part of vehicles entering or exiting the parking lot may not drive over two of the magnetometers, which can lead to a greater amount of inaccuracy in the determination of speed and direction of the vehicle. By arranging four magnetometers into a rectangular shape, the likelihood of the same part of vehicles entering or exiting the parking lot not driving over two of the magnetometers is reduced, with the tradeoff being the use of an additional magnetometer together with the spending of processing power to analyze the data from that additional magnetometer.

Potential network topologies for the parking system 50 are now described with reference to FIG. 8. In some cases, the parking lot in which the system 50 is located may be small enough such that a single modem is in communication distance with each sensor apparatus, such as that shown in FIG. 8 where modem 49*d* is in communication with sensor apparatuses 52*h*-52*j*.

However, in some cases, the parking lot in which the system 50 is located may be too large, or may be multi-level, for direct communication between each sensor apparatus and the modem to be feasible. Thus, in these cases, repeaters may be used. For example, as shown in FIG. 8, sensor apparatuses 52*f*-52*g* on a first floor or in a first area may communicate with repeater 49*c*, which in turn communicates with repeater 49*b* on a second floor or in a second area, which in turn communicates with modem 49*a* on a third floor or in a third area. Here, repeater 49*b* communicates with sensor apparatuses 52*d*-52*e*, and modem 49*a* communicates with sensor apparatuses 52*a*-52*c*.

With additional reference to FIG. 13, an alternative embodiment of the parking system 50' is now described. Here, instead of or in addition to the comparison of the waveforms from the magnetometer 54 to waveforms from other magnetometers, the server 60 or processing circuitry 53 may instead compare the waveforms from the magnetometer 54 to a knowledge base of known waveforms for known vehicles. Each known vehicle may have multiple known waveforms associated with it and stored in the knowledge base. These multiple known waveforms for each known vehicle may each be a waveform of the vehicle driving over the sensor apparatus 52 from a different direction or angle. These known waveforms may each be directly measured using a sensor apparatus identical to, or similar to, that of the sensor apparatus 52; alternatively, some known waveforms may be directly measured, while others may be extrapolated from those that were directly measured.

When the server 60 or processing circuitry 53 locates a match between a waveform from the magnetometer 54 and a known waveform, the server 60 or processing circuitry 53 can then retrieve information about the known vehicle associated with that waveform, such as the make and model, vehicle orientation, direction of travel, and position of vehicle relative to the sensor apparatus 52. This is possible because a vehicle of a given make and model will produce a different waveform depending on the direction or orientation in which it is facing and traveling as it drives over the sensor apparatus 52. Thus, for example, waveforms from magnetometer 54 may match those of a Ford F-150 driving across the sensor apparatus 52 at a 45 degree angle from the lower left corner of the sensor apparatus 52 to the upper right corner of the sensor apparatus 52. As another example, waveforms from magnetometer 54 may match those of a Toyota 4Runner driving across the sensor apparatus 52 from the right to the left, with the sensor apparatus substantially centered along a longitudinal axis of the vehicle, in a reverse direction. Thus, it can be seen that through match measured waveforms to known waveforms for known vehicles, a varieties of pieces of information about the vehicle may be deduced.

Instead of comparing each measured waveform from the magnetometer 54 to a knowledge base, in some cases, the server 60 or processing circuitry 53 may use a learned machine technique to identify the make, model, vehicle orientation, direction of travel, and position of the vehicle relative to the sensor apparatus 52. This learned machine technique, utilized by the server 60 or magnetometer, may be produced using a machine learning technique (such as using an artificial neural network) performed on the aforementioned knowledgebase or similar, and may be continually updated.

Regardless of the technique employed (either matching or machine learning) to determine the make, model, vehicle orientation, direction of travel, and position of the vehicle relative to the sensor apparatus 52, the speed of the vehicle may be estimated from the length of the known identified vehicle multiplied by the duration of the measured waveforms from the magnetometer 54.

It should also be understood that in some instances, accelerometers may be used in conjunction with magnetometers. For example, the accelerometers may be positioned adjacent to the magnetometers, and vibration signatures may be collected together with the magnetic signatures. In addition, the vibration signatures may be compared and analyzed like the magnetometers as described above, and the results thereof may be fused or combined with the results of comparing and analyzing the magnetic signatures to produce more accurate results. Furthermore, in some instances, accelerometers may be used instead of magnetometers, and vibration signatures may be collected, compared, and analyzed like the magnetometers as described above.

Although the preceding description has been described herein with reference to particular means, materials and embodiments, it is not intended to be limited to the particulars disclosed herein; rather, it extends to all functionally equivalent structures, methods, and uses, such as are within the scope of the appended claims.

The invention claimed is:

1. A system comprising:

at least one sensor comprising a magnetometer, each sensor of the at least one sensor configured to generate a magnetic signature of a vehicle as it drives across the at least one sensor;

a computing device configured to perform an analysis of the magnetic signature of the vehicle as received from the at least one sensor, wherein the analysis includes comparing the magnetic signature of the vehicle as received from the at least one sensor to known magnetic signatures of known vehicle types to thereby determine a direction of travel of the vehicle relative to the magnetometer based upon the comparison, wherein each known vehicle type is associated with multiple known magnetic signatures, and wherein each of the multiple known magnetic signatures associated with each known vehicle type is a magnetic signature of that vehicle type captured during driving of a vehicle of the vehicle type over the sensor from a different direction.

2. The system of claim 1, wherein the at least one sensor comprises a single sensor.

3. The system of claim 1, wherein the sensor is disposed at an entrance or exit to a parking lot, wherein a cloud server in operative communication with the computing device is configured to increment a counter representing a number of cars in the parking lot as a function of the direction of travel of the vehicle being into the parking lot; and wherein the cloud server in operative communication with the computing device is further configured to decrement the counter as a function of the direction of the vehicle being out of the parking lot.

4. The system of claim 1, further comprising a network transceiver associated with the computing device and configured to send the magnetic signature of the vehicle to the computing device; and wherein the computing device is a cloud server.

5. The system of claim 1, wherein the computing device is further configured to determine a make and model of the vehicle to be equal to the make and model of a matching known magnetic signature of a known vehicle.

6. The system of claim 1, wherein the computing device is further configured to, during an initial training phase, execute a machine learning technique using each of the known magnetic signatures of known vehicle types; and wherein the computing device performs the analysis of the magnetic signature by performing a machine identification technique, learned based upon the machine learning technique, on the magnetic signature.

7. The system of claim 6, wherein the computing device performs the machine identification technique so as to determine at least one of (i) a make and model of the vehicle, (ii) a speed of the vehicle, (iii) the direction of travel of the vehicle, and (iv) a position of the vehicle.

8. The system of claim 1, wherein the computing device performs the analysis of the magnetic signature of the vehicle by comparing the magnetic signature of the vehicle to each of the known magnetic signatures of known vehicle types, and is further configured to determine a make and model of the vehicle to be equal to the make and model of a matching known magnetic signature of a known vehicle type.

9. The system of claim 8, wherein the computing device is further configured to determine a position of the vehicle as a function of which of the known magnetic signatures for the given known vehicle type matching the make and model of the vehicle was matched by the magnetic signature of the vehicle.

10. The system of claim 8, wherein the computing device is further configured to determine a speed of the vehicle as a function of which of the known magnetic signatures for the given known vehicle types matching the make and model of the vehicle types was matched by the magnetic signature of the vehicle and a duration of the magnetic signature of the vehicle.

11. The system of claim 2, wherein the single sensor comprises at least four magnetometers arranged in a rectangular pattern inside a single housing.

12. A method of determining direction of a vehicle, the method comprising:

acquiring a magnetic signature of the vehicle as it drives past a single sensor comprising at least one magnetometer;

performing an analysis of the magnetic signature of the vehicle as received from the single sensor to determine the direction of travel of the vehicle, wherein the analysis of the magnetic signature of the vehicle comprises comparing the magnetic signature of the vehicle to known magnetic signatures, wherein each known vehicle type has a plurality of known magnetic signatures associated with each known vehicle type, wherein each known vehicle type is associated with multiple known magnetic signatures, and wherein each of the multiple known magnetic signatures associated with each known vehicle type is a magnetic signature of that vehicle type captured during driving of a vehicle of the vehicle type over the single sensor from a different direction.

13. The method of claim 12, further comprising, during an initial training phase, executing a machine learning technique using known magnetic signatures of known vehicle types; and wherein the analysis of the magnetic signature of the vehicle is performed using a machine identification technique, learned based upon the machine learning technique, on the magnetic signature.

14. The method of claim 13, wherein the analysis of the magnetic signature of the vehicle is performed by comparing the magnetic signature of the vehicle to known magnetic signatures of known vehicle types, and wherein the analysis determines a make and model of the vehicle to be equal to a make and model of a matching known magnetic signature of a known vehicle type from among the known magnetic signatures of the known vehicle types.

15. The method of claim 13, wherein the direction of travel of the vehicle is determined as a function of which of the known magnetic signatures for the known vehicle type matching the make and model of the vehicle was matched by the magnetic signature of the vehicle.

16. The method of claim 13, wherein a speed of the vehicle is determined as a function of which of the known magnetic signatures for the known vehicle type matching the make and model of the vehicle was matched by the magnetic signature of the vehicle and a duration of the magnetic signature of the vehicle.

17. A system comprising:

a single sensor comprising a housing enclosing at least one magnetometer configured to acquire a magnetic signature of a vehicle as it drives past the single sensor; and a computing device configured to perform an analysis of the magnetic signature of the vehicle to determine a direction of the vehicle, wherein the analysis includes comparing the magnetic signature of the vehicle as received from the single sensor to known magnetic signatures of known vehicle types to thereby determine the direction of travel of the vehicle relative to the magnetometer based upon the comparison, wherein each known vehicle type is associated with multiple known magnetic signatures, and wherein each of the multiple known magnetic signatures associated with each known vehicle type is a magnetic signature of that vehicle type captured during driving of a vehicle of the vehicle type over the sensor from a direction.

* * * * *